US006567342B1

(12) United States Patent
Purcell et al.

(10) Patent No.: US 6,567,342 B1
(45) Date of Patent: May 20, 2003

(54) FLARED WAVE-GUIDE PROJECTOR

(75) Inventors: Christopher John A. Purcell, Dartmouth (CA); Richard Alfred G. Fleming, Tignish (CA)

(73) Assignee: Her Majesty the Queen in right of Canada, as represented by the Minister of National Defence, Ottawa (CA)

( * ) Notice: Subject to any disclaimer, the term of this patent is extended or adjusted under 35 U.S.C. 154(b) by 0 days.

(21) Appl. No.: 10/171,687

(22) Filed: Jun. 17, 2002

(51) Int. Cl.[7] ..... H04R 17/10; H04R 17/00

(52) U.S. Cl. ..... 367/176; 367/157; 367/162; 367/165; 310/337

(58) Field of Search ..... 367/150, 153, 367/155, 159, 163, 166, 174, 162, 165; 310/337; 181/177, 182, 180, 189, 192, 196

(56) References Cited

U.S. PATENT DOCUMENTS 3,872,421 A * 3/1975 Rogers et al. ..... 310/322
4,855,964 A * 8/1989 Fanning et al. ..... 310/337
4,922,470 A * 5/1990 McMahon et al. ..... 310/337
5,047,997 A 9/1991 Forsberg
5,062,089 A 10/1991 Willard et al.
5,119,343 A * 6/1992 Katahara ..... 181/106
5,289,436 A * 2/1994 Terhune ..... 181/400
5,315,917 A * 5/1994 Mayzes ..... 367/120
5,805,529 A * 9/1998 Purcell ..... 367/163

FOREIGN PATENT DOCUMENTS

CA 1319414 9/1988

* cited by examiner

*Primary Examiner*—Ian J. Lobo
(74) *Attorney, Agent, or Firm*—Larson & Taylor, PLC

(57) ABSTRACT

An underwater acoustic projector comprising a pair of spaced apart end walls with an acoustic driver positioned between the end walls, the driver having smaller cross-sectional dimensions than the end walls. Each end wall close one end of flared open ended pipe waveguides and is mechanically coupled to one end of a piezoelectric acoustic driver. The flared pipe waveguides extend outward from the driver and have a larger diameter at their open ends than at the end walls.

18 Claims, 6 Drawing Sheets

FLARED WAVE-GUIDE PROJECTOR

FIELD OF THE INVENTION

The present invention relates to acoustic projectors, especially projectors for use in low frequency military and civilian sonar systems, and in particular to underwater acoustic projectors having highly stable performance with depth, improved frequency range and reduced manufacturing costs due to lower mechanical tolerances being required than in existing acoustic projectors.

BACKGROUND OF THE INVENTION

Low frequency military and civilian sonar systems require compact, light weight, high power, efficient, wide bandwidth acoustic projectors whose performance is stable with depth and linear with drive voltage levels and which have a low manufacturing and maintenance cost.

Flextensional projectors are amongst the best ones presently available to meet the military and civilian sonar systems requirements, a known flextensional projector being the barrel stave type. The barrel stave projector (BSP) is a compact, low frequency underwater sound source which has applications in low frequency active (LFA) sonar and in underwater communications.

Variants of this known BSP have been built to optimise light weight, wide bandwidth, low frequency, high power, and improved electroacoustic efficiency. Efficiency is an especially critical parameter for the high power versions of the BSP because the driver is well insulated from the water thermally by a boot on the outer surface of projector that is required for waterproofing. The boot's relatively poor thermal conductivity contributes to the difficulty in cooling the BSP. The BSPs are relatively costly to manufacture and maintain.

A one-piece flextensional shell projector is described by Christopher Purcell in U.S. Pat. No. 5,805,529. The surface of this projector is formed of a thin-walled one-piece inwardly concavely shaped shell containing corrugations running in the axial direction. This one-piece shell is slotless which eliminates the requirement for a boot. The shell is, however, relatively costly to manufacture since it is complex in shape and must be made to fine tolerances.

Canadian Patent 1,319,414 by Bryce Fanning et al that issued on Jun. 22, 1993 describes one type of a free-flooding piezoelectrically driven resonant-pipe projector (RPP) with vent holes in the pipe walls to broaden the response of certain cavity resonances and to increase the response between those resonances. The drive unit is a radially-poled lead zirconate-titanate cylinder with aluminium pipes extending into the center of the piezoelectric drive unit, the pipes being mechanically coupled to the drive unit. To accomplish the necessary acoustic coupling between the drive unit and pipes requires a close mechanical fit to couple the drive unit to the pipes. These resonant pipe projectors are partially free-flooding and can be operated at extreme depths because the drive unit is highly resistant to hydrostatic loading. However, the bandwidth is small and they are expensive to manufacture due to the close tolerances required.

SUMMARY OF THE INVENTION

It is an object of the invention to provide an acoustic projector with reduced depth sensitivity when submerged in water, improved frequency range and reduced manufacturing costs.

An acoustic projector, according to one embodiment of the present invention, comprises a pair of spaced apart end walls with an acoustic driver positioned between and coupled to the end walls, the driver having smaller cross-sectional dimensions than the end walls which have flared pipe waveguides extending outward from the driver, outer ends of the waveguides having a larger diameter than other portions of the waveguides.

BRIEF DESCRIPTION OF THE DRAWINGS

The invention will now be described in more detail with reference to the accompanying drawings, in which.

DESCRIPTION OF THE PREFERRED EMBODIMENTS

Low frequency military and civilian sonar systems require compact, light weight, high power, efficient, wide bandwidth acoustic projectors whose performance is stable with depth and linear with drive voltage levels as well as being low in cost to manufacture and maintain.

Flextensional projectors are amongst the best ones presently available to meet the requirements for military and civilian sonar systems. One type of flextensional projector, known as the barrel stave projector (BSP), is described in U.S. Pat. No. 4,922,470 by G. W. McMahon et al. This barrel stave projector contains a driver formed of a stack of axially poled piezo-electric ceramic rings and an enclosure formed by a set of curved bars (staves) with polygonal end plates. The staves are secured to flat sides of the octagonal end plates and axial motion of the stave ends is transformed to a larger radial motion of the staves midpoints.

Another flextensional acoustic projector is described by Christopher Purcell in U.S. Pat. No. 5,805,529. This projector has a one-piece slotless flextensional shell for an underwater acoustic projector which is inwardly concavely shaped similar to the BSP but which does not require any boot. The one-piece shell has no gaps or openings in its outer surface. This shell achieves the required low hoop stiffness for low frequency operation by using folds rather than slots as used in the BSP. This Folded Shell Projector's (FSP) surface is formed of a thin-walled one-piece inwardly concavely shaped shell containing corrugations (folds) running in the axial direction.

Figure 1:
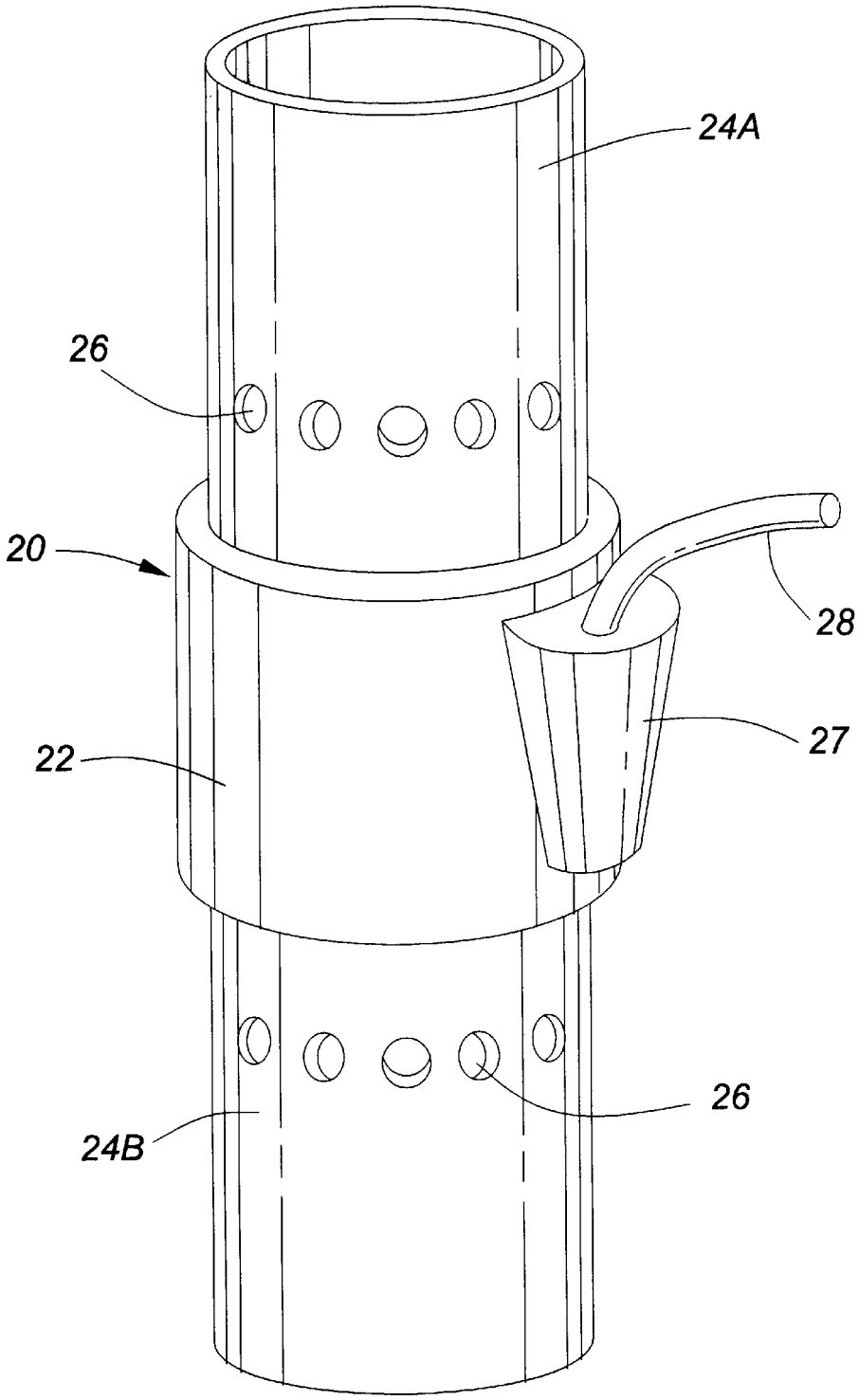
PRIOR ART FIG. 1
FIG. 1 is a perspective view of a known resonant pipe projector.

Canadian Patent 1,319,414 by Bruce Fanning et al which issued on Jun. 22, 1993 describes one known type of a partially free-flooding piezoelectric driven resonant pipe projector (RPP) which is illustrated in FIG. 1. This RPP 20 contains vent holes 26 in the pipe walls 24A and 24B to broaden the response of certain cavity resonances and to increase the response between those resonances. The drive unit 22 is a radially-poled lead zirconate-titanate cylinder with the aluminum pipes 24A and 24B extending into that cylinder where they are mechanically coupled to the inner surface of the drive unit. To accomplish the necessary acoustic coupling between the drive unit 22 and the pipes requires a close mechanical fit between those parts. This type of RPP are partially free-flooding and can be operated at extreme depths since the drive unit is highly resistant to hydrostatic loading. However, their bandwidth is small and they are expensive to manufacture due to the close mechanical tolerances required.

An axial drive resonant pipe projector (ADRPP) described in co-pending Canadian Patent Application 2,357,605, which corresponds to copending U.S. Pat. application Ser. No. 09/957,454, is a partially free-flooding acoustic projector that can be operated at extreme depths because the piezoelectric drive unit is highly resistant to hydrostatic loading. This ADRPP has a balanced pair of free flooded constant radius pipes (waveguides) with opposed open ends and integral end walls connected to a piezoelectric drive unit with stress rods holding the end plates against the drive unit. This ADRPP is best illustrated in the cross-sectional view of FIG. 2. This ADRPP is lightweight, compact and inexpensive to manufacture because the drive motor does not have to precisely fit the outside circumference of a resonant pipe as required in other RPPs such as those described in Canadian Patent 1,319,414.

Figure 2:
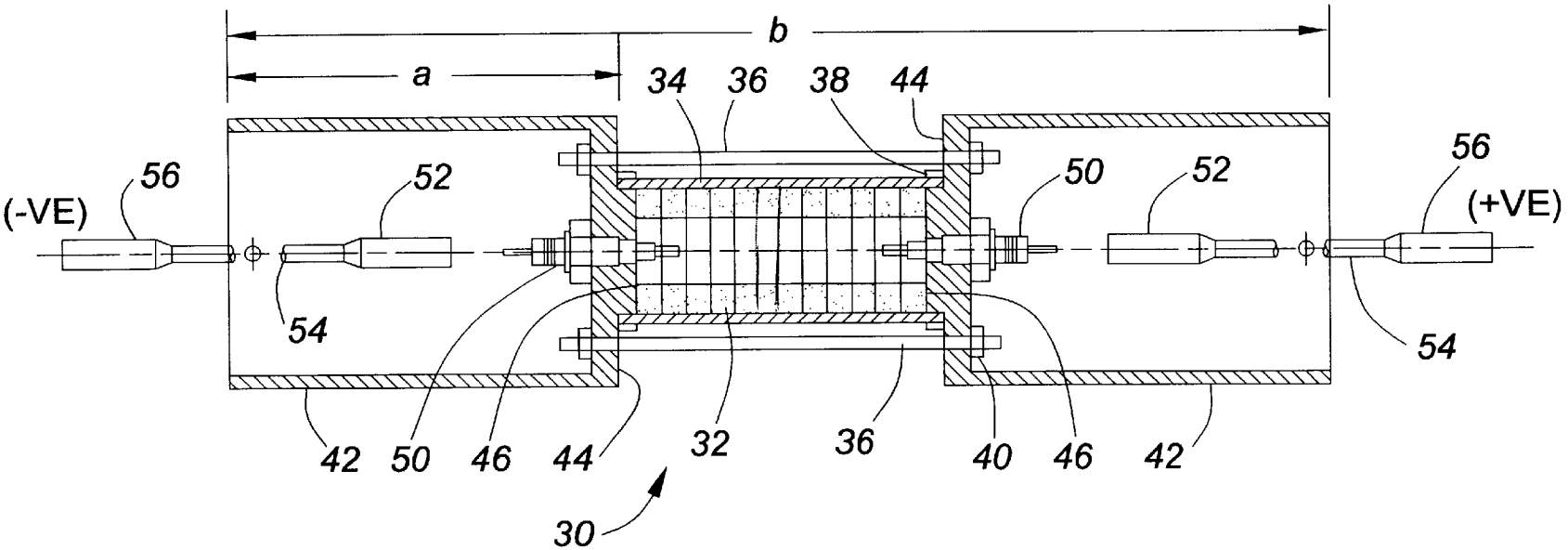
PRIOR ART FIG. 2
FIG. 2 is a cross-sectional view of a known axial drive resonant pipe projector (ADRPP)

That axial driven resonant pipe projector 30, illustrated in cross-section in FIG. 2, contains a 12 ring ceramic stack piezoelectric drive element 32, the rings having nominal dimensions of 2 inch outer diameter, 0.4 inch axial length and 0.505 inch wall thickness. To water-tight seal the stack 32 from sea-water, a 0.075 inch thick neoprene boot 34 was used to isolate the active components and it is bonded to the stack 32 by restraining clamps 38 clamped on the central boss 46 of the end walls 44 at either end of the stack 32. An alternative to the neoprene boot is that one or more drive motors may be waterproofed by a coating. Although a stack of 12 ceramic rings are shown in FIG. 2, that number may be varied or a single piezoelectric cylinder used.

The waveguides 42 at opposite ends of the stack 32 consists of tubular pipes with open ends facing away from stack 32 and integrally formed end walls 44, each end wall has a central boss 46 that presses against the ends of stack 32. That boss 46 serves a dual purpose in that (1) it serves to increase the wall thickness to maintain peak operational bending stresses in the end-wall below the endurance limit of the aluminum end wall and (2) it facilitates the water-tight sealing of the neoprene boot 34 to stack 32. The end walls 44 are shown as being integrally formed with the tubular pipes but these could be formed separately and the central bosses 46 would not be necessary when the drive element is waterproofed with a coating rather than a boot. The waveguides 42 in a prototype projector were machined from solid stock Aluminum 6061-T6 with an outer diameter of 4.5 inches and a nominal wall thickness of 0.25 inches. The base of the waveguides, i.e. end walls 44, were 0.5 inches thick with a central boss 46 having a height of 0.25 inches and a 2 inch diameter.

Electrical connectors 50 extend through a central opening in the central boss 46 and are wired to the ceramic rings in stack 32. The connectors 50 are sealed in a water proof manner to the end walls 44 and are wired to an insulated conductor 54 via a connector 52.

Four stress rods 36 extend through aligned openings in the two end walls 44 and locknuts 40 at each end of the stress rods press the end walls 44 towards each other and against the ceramic ring stack 32. The stress rods 36 are put into tension by the locknuts 40 and the ceramic stack 32 into compression at the time of manufacture. In the prototype unit, the four stress rods in this unit were threaded rod grade 8 alloy steel (yield strength of 120 ksi) with the locknuts 40 being appropriate Grade 8 high strength nylon insert locknuts. This allowed the axial stiffness of the stress rods to be kept at about 12% of the ceramic stack and the level of prestressing at 1.25 times the peak dynamic load in the stack.

The projector illustrated in FIG. 2 is lightweight, compact and inexpensive to manufacture compared to other resonant pipe projectors. The tuning of the longitudinal mode of this projector may be achieved by varying the length of the waveguides, the length of the motor, the end wall dimensions and the material properties. To lower the frequency of the operational band, low sound speed fluids may be sealed into the waveguide volumes by means of a flexible membrane covering their ends. The projector does have a narrow bandwidth but narrow bandwidth projectors are relative easy to power efficiently and, therefore, are highly suited to low cost battery operated expendable applications where a highly efficient sonar system (including amplifier, transformer and projector) is required.

Figure 3:
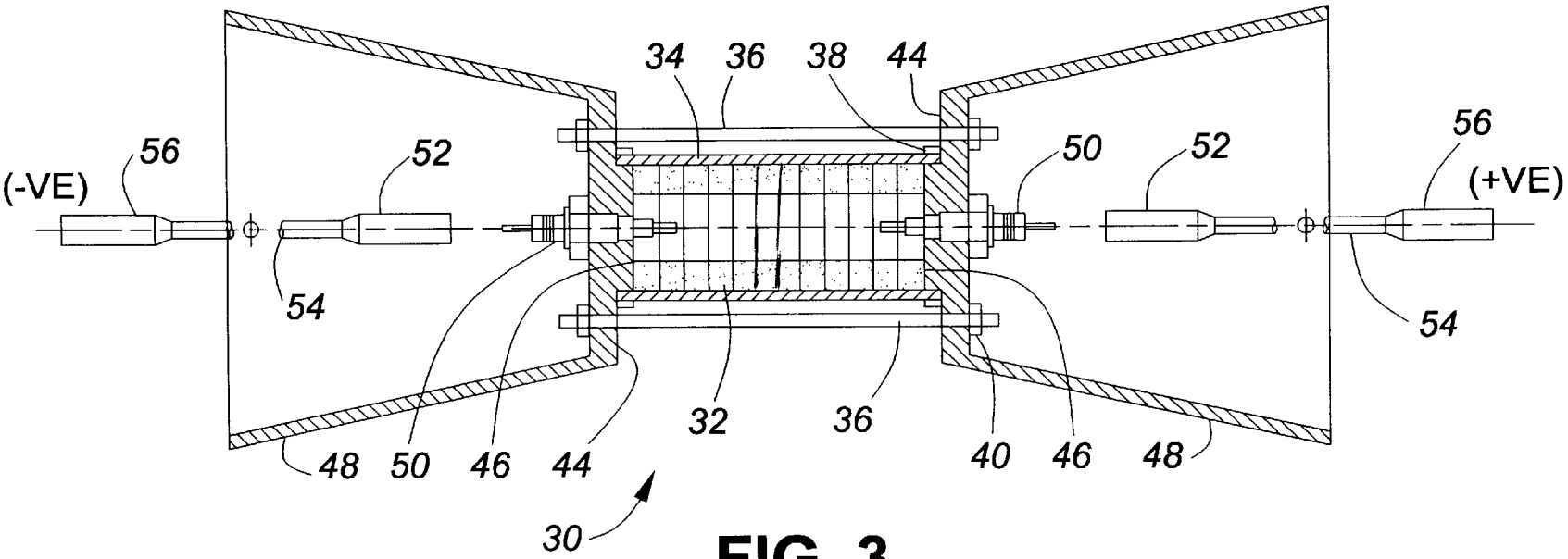
FIG. 3 is a cross-section view of a flared waveguide projector (FWP) according to one embodiment of the present invention.

A Flared Waveguide Projector (FWP) according to one embodiment of invention is illustrated in the cross-sectional view of FIG. 3 and it is identical to the ADRPP described with respect to FIG. 2 except for the open ended tubular pipe waveguides 42. In the embodiment of the FWP illustrated in FIG. 3, the waveguides 48 at each end of the FWP are flared to form a conical or horn shape that provides a better acoustic impedance match to the surrounding water.

Figure 4:
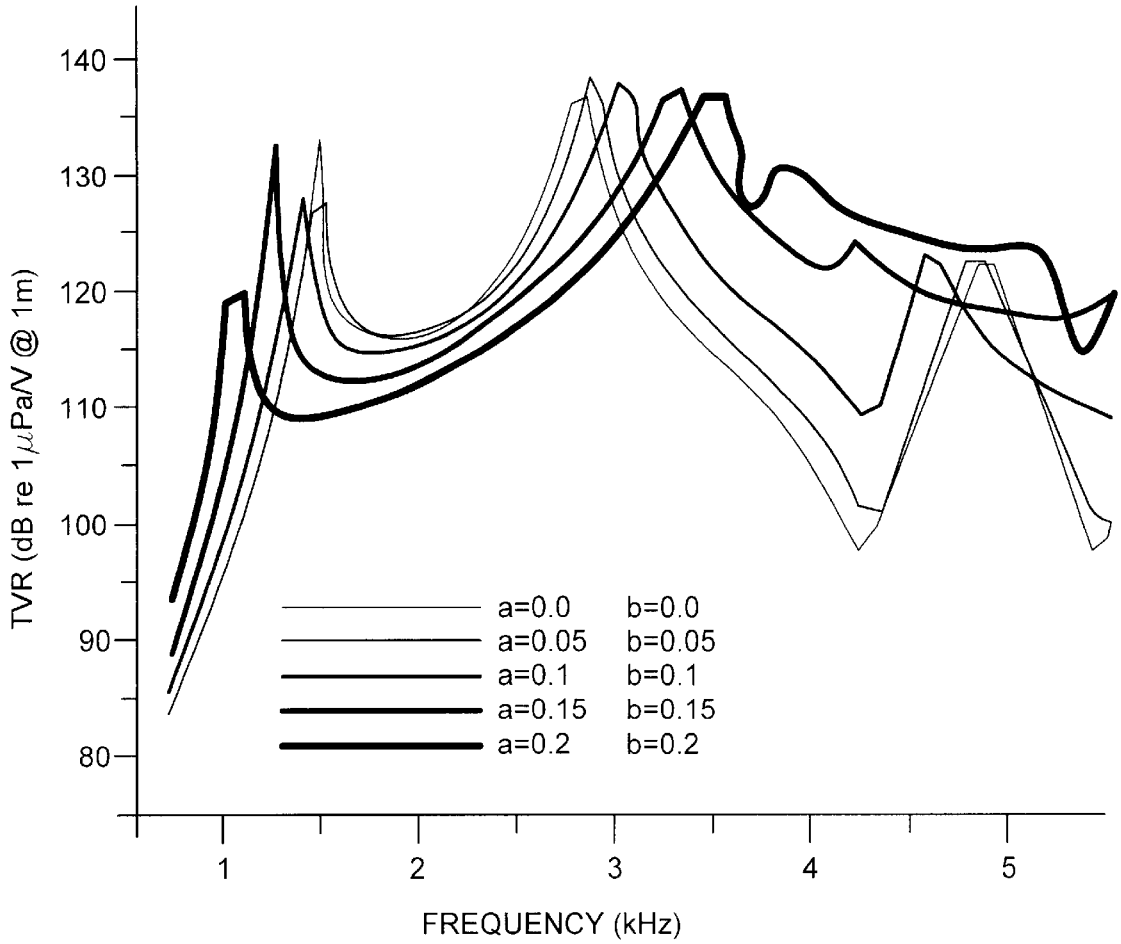
FIG. 4 are graphs of the frequency response (TVR's) at a horizontal axis for various waveguide flares obtained using a finite element model computer program MAVART developed at Defence Research Establishment Atlantic.

The MAVART Version 14 (a computer program developed at Defence Research Establishment Atlantic) was used to predict the performance of the FWP model. The function z=aExp[br], (where r is the inside radius of the waveguide, z is the axial coordinate from the waveguide bottom and a and b are parameters that are used to define the shape of the flare) was used to describe the waveguide sections in the FWP model. It was applied to waveguide wall sections in the flared waveguides projector model to obtain predicted responses for a series of waveguide flares and determine their characteristic with different flare angles. The frequency responses of a FWP with different flare angles are shown in the graphs in FIG. 4 where the transmitting voltage response TVR (dB re 1 $\mu$Pa/v @1 m) is plotted against frequency (kHz). FIG. 4 shows that as the flare angle of the FWPs waveguides increase the first and third resonance frequencies decrease while the second resonance frequency increases.

The graphs in FIG. 4 demonstrate that even though the first and second mode shapes were similar, the effect of different endcap nodal locations caused the difference in direction of the frequency shift of the first and second resonances when the waveguide flares were altered. Since the third resonance mode is a breathing mode, its resonance frequency dropped with respect to the ADRPP due to increased mass loading of the water. In effect, the first and third mode coupling to the water increased and thus their frequencies dropped.

The following table illustrates the resonance frequency shift shown in FIG. 4 due to increase in the waveguide flare angle, flare parameters a,b with F1, F2 and F3 being resonance frequencies and the TVR levels are in (dB re 1 $\mu$Pa/v @1 m).

TABLE 1

| a | b | F1 | F2 | F3 |
|---|---|---|---|---|
| 0 | 0 | 1410 Hz @ 138.5 dB | 2730 Hz @ 139 dB | 4830 Hz @ 125 dB |
| 0.05 | 0.05 | 1390 Hz @ 138.5 dB | 2790 Hz @ 139 dB | 4750 Hz @ 124.5 dB |
| 0.10 | 0.10 | 1320 Hz @ 138 dB | 2940 Hz @ 139 dB | 4520 Hz @ 124.8 dB |
| 0.15 | 0.15 | 1190 Hz @ 136 dB | 3210 Hz @ 138.2 dB | 4130 Hz @ 125.6 dB |
| 0.20 | 0.20 | 1010 Hz @ 133 dB | 3410 Hz @ 138 dB | 3780 Hz @ 132 dB |

A drawback to lowering the first resonance mode frequency by increasing the flare angle is that the outside diameter of the projector, i.e. outer diameter of the waveguide, will be increased. According to the trend illustrated in FIG. 4, increasing the flare angle of the FWP waveguide makes it possible to lower the third resonance mode frequency below the second and the device can be improved into a more usable projector.

Figure 5:
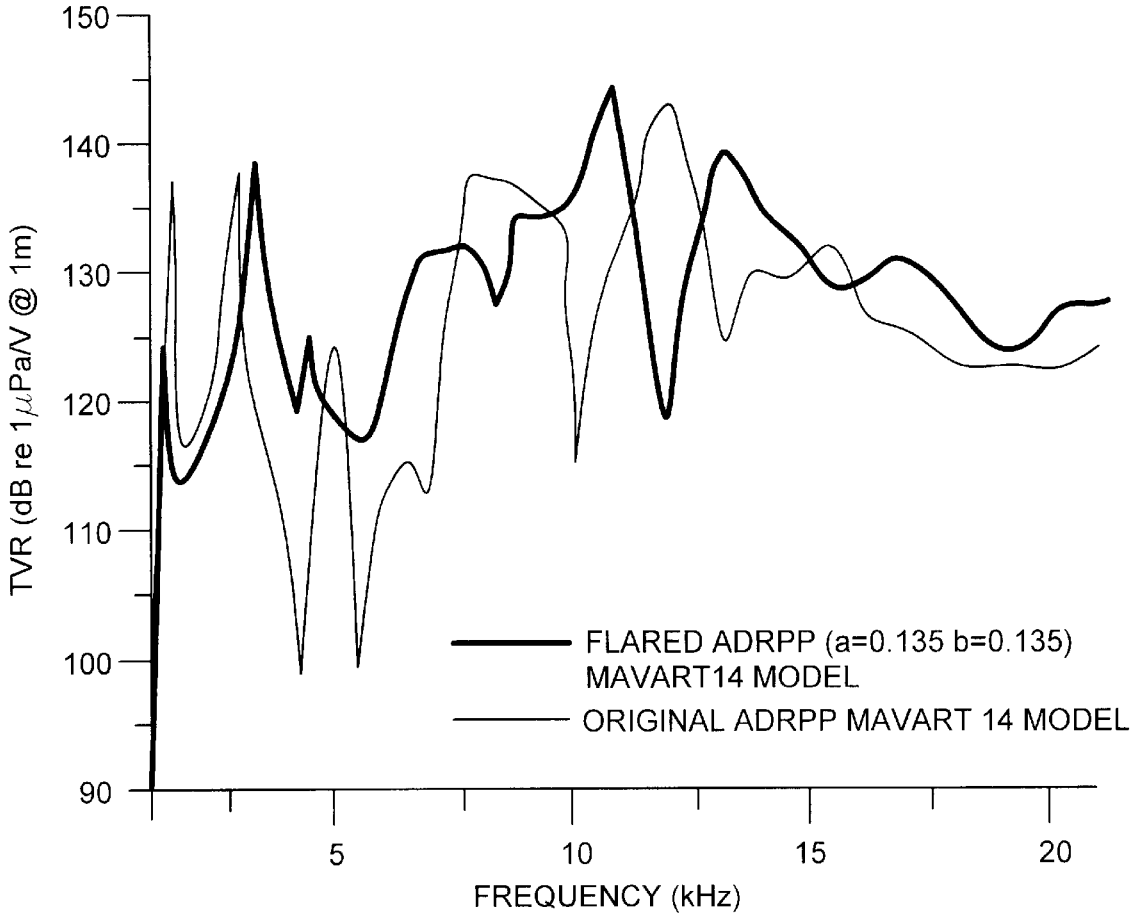
FIG. 5 are graphs for a FWP (a=0.135, b=0.135) frequency response versus that obtained for the ADRPP, that is shown in cross-section FIG. 2.
Figure 6:
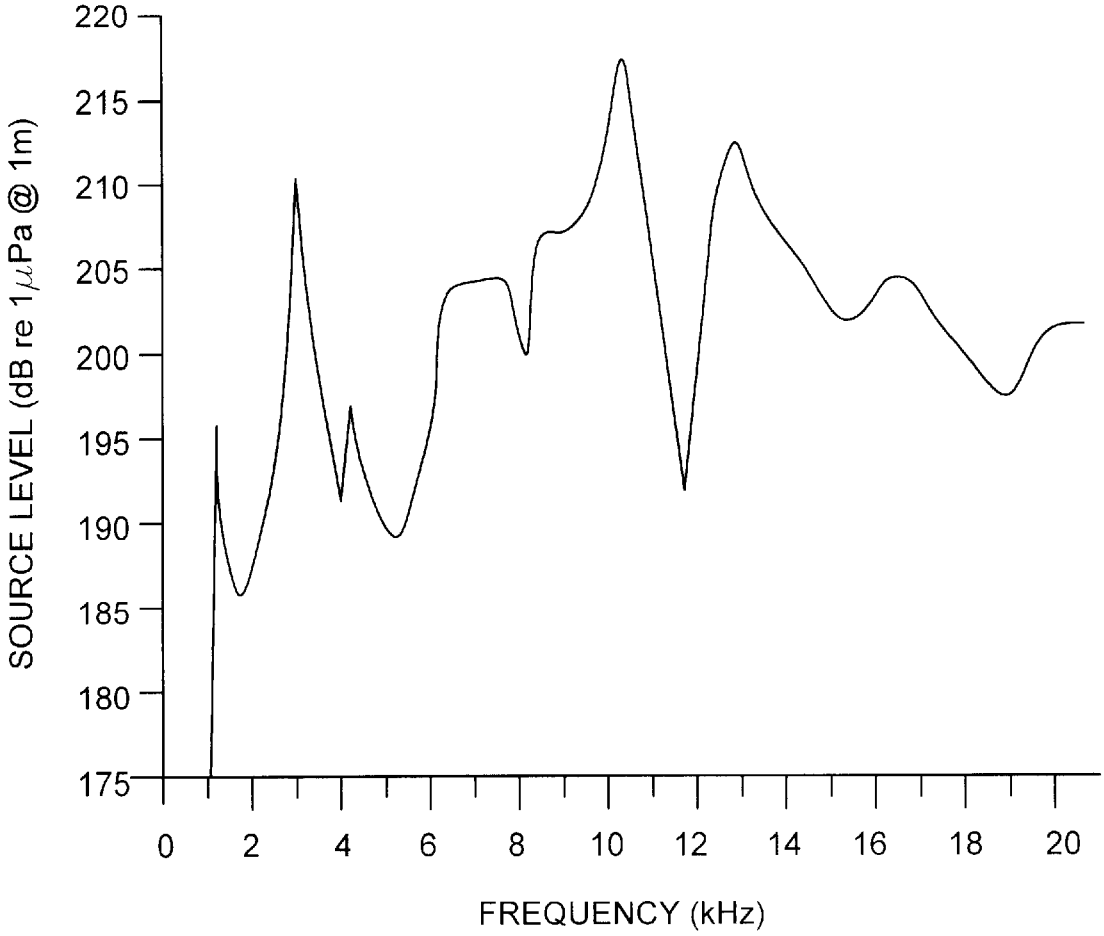
FIG. 6 is a graph showing a source level plot (dB re 1 $\mu$Pa@1 m) obtained for a flared FWP with a=0.135 and b=0.135 from the horizontal axis.

FIG. 5 shows that this FWP is a more useable one than the ADRPP with a flatter frequency response, FIG. 5 shows the frequency response of the original ADRPP MAVART 14 model and that of the FWP, a flared ADRPP (a=0.135, b=0.135 waveguides). In this model, both the "a" and "b" parameters were set at 0.135. With a drive voltage of 4000 rms, a source level exceeding 186 dB was realized over a band from 1.15 to at least 21 kHz as shown in FIG. 6.

Various modifications may be made to the described FWP without departing from the spirit and scope of the invention as defined in the appended claims. The waveguides, for instance, may have a tubular portion adjacent to the end walls with an increasing flare angle as the distance from the end walls increases forming a curved horn section. The waveguides can be sealed with flexible polymer membranes and filled with a low sound speed fluid such as a fluorosilicone oil to lower the resonance frequency. A single waveguide could be applied to only one end of the FWP, with less benefit than application to both ends, but still producing a gain in bandwidth. This configuration may be used when one end of the projector is fixed to an inertial mass that serves as an attachment point.

The embodiments of the invention in which an exclusive property or privilege is contained is claimed are defined as follows:

1. An acoustic projector comprising a pair of spaced apart end walls with an acoustic piezoelectric driver positioned between and coupled to the end walls, the driver having smaller cross-sectional dimensions than the end walls which have flared pipe waveguides extending outward from said driver, outer ends of said waveguides being open and having a larger diameter at the outer ends than at the end walls.

2. An acoustic projector as defined in claim 1, wherein the end walls contain apertures and stress rods with threaded ends extend through aligned apertures in the spaced apart end walls, locknuts on threaded portions of the stress rods pressing the end walls towards each other and against the acoustic driver.

3. An acoustic projector as defined in claim 2, wherein the acoustic piezoelectric driver comprises a stack of piezoelectric rings and each end wall has a circular central boss that extends toward and presses against said stack.

4. An acoustic projector as defined in claim 3, wherein said stack is surrounded by a waterproof boot having each end fastened to one of said central bosses by a clamp.

5. An acoustic projector as defined in claim 4 where an electrical connector extends through a central opening in an end wall to provide electrical connections to said rings, each connector being sealed to an associated end wall in a waterproof manner.

6. An acoustic projector as defined in claim 2, wherein the acoustic piezoelectric driver comprises a stack of piezoelectric rings and each end wall has a circular central boss that extends toward and presses against said stack.

7. An acoustic projector as defined in claim 6, wherein said stack is surrounded by a waterproof boot having each end fastened to one of said central bosses by a clamp.

8. An acoustic projector as defined in claim 7, wherein an electrical connector extends through a central opening in a boss to provide electrical connections to said rings, each connector being sealed to an associated end wall in a waterproof manner.

9. An acoustic projector as defined in claim 1, wherein the flare angle of the waveguides is constant and forms conical waveguides.

10. An acoustic projector as defined in claim 1, wherein the flare angle of the waveguides increases with distance from the end walls.

11. An acoustic projector comprising a pair of spaced apart end walls with an acoustic piezoelectric driver positioned between and coupled to the end walls, the driver having smaller cross-sectional dimensions than the end walls which have flared pipe waveguides extending outward from said end walls, outer ends of the waveguides having a larger diameter than other portions of the waveguide, the outer ends being sealed with polymer membranes and the waveguides filled with a low sound speed fluid.

12. An acoustic projector as defined in claim 11, wherein the acoustic piezoelectric driver comprises a stack of piezoelectric rings and each end wall has a circular central boss that extends toward and presses against said stack.

13. An acoustic projector as defined in claim 11, wherein the flare angle of the waveguides is constant and forms conical waveguides.

14. An acoustic projector as defined in claim 11, wherein the flare angle of the waveguides increases with distance from the end walls.

15. An acoustic projector comprising a pair of spaced apart end walls with an acoustic piezoelectric driver positioned between and coupled to the end walls, the driver having smaller cross-sectional dimensions than the end walls, at least one end wall having a flared pipe waveguide extending outward from the driver with an outer end of the waveguide having a larger diameter than other portions of the waveguide.

16. An acoustic projector as defined in claim 15, wherein the acoustic piezoelectric driver comprises a stack of piezoelectric rings and each end wall has a circular central boss that extends toward and presses against said stack.

17. An acoustic projector as defined in claim 15, wherein the flare angle of the waveguides is constant and forms conical waveguides.

18. An acoustic projector as defined in claim 15, wherein the flare angle of the waveguides increases with distance from the end walls.

* * * * *